US007235339B2

(12) United States Patent
Casalmir et al.

(10) Patent No.: US 7,235,339 B2
(45) **Date of Patent: *Jun. 26, 2007**

(54) METHOD OF BLENDING TONERS USING A HIGH INTENSITY BLENDING TOOL WITH SHAPED RISERS FOR DECREASED TONER AGGLOMERATION

(75) Inventors: D Paul Casalmir, Sodus, NY (US); Samir Kumar, Pittsford, NY (US); Fumii Higuchi, Mississauga (CA)

(73) Assignee: Xerox Corporation, Stamford, CT (US)

( * ) Notice: Subject to any disclaimer, the term of this patent is extended or adjusted under 35 U.S.C. 154(b) by 271 days.

This patent is subject to a terminal disclaimer.

(21) Appl. No.: 10/975,678

(22) Filed: Oct. 28, 2004

(65) Prior Publication Data

US 2006/0093957 A1 May 4, 2006

(51) Int. Cl.
*G03G 9/08* (2006.01)

(52) U.S. Cl. ..... 430/137.21; 366/314

(58) Field of Classification Search ..... 430/137.21; 366/314

See application file for complete search history.

(56) References Cited

U.S. PATENT DOCUMENTS

| | | | | |
|---|---|---|---|---|
| 61,772 | A | 2/1867 | Steinmetz | 366/325.9 |
| 87,691 | A | 3/1869 | Marsh | 366/328.2 |
| 330,555 | A | 11/1885 | Brandenberger | 366/325.91 |
| 1,536,203 | A | 5/1925 | Frydenlund | |
| 2,223,018 | A | 11/1940 | Christensen | |
| 2,235,604 | A | 3/1941 | Braumagim | 259/107 |
| 2,702,571 | A | 2/1955 | Murray | |
| 3,024,010 | A | 3/1962 | Karl-Heinz | |
| 3,545,729 | A | 12/1970 | Scholl et al. | |
| 4,091,457 | A | 5/1978 | Slywka | |
| 4,260,267 | A | 4/1981 | Walton | |
| 5,056,926 | A | 10/1991 | Bouheben | |
| 5,655,834 | A | 8/1997 | Dickson | |
| 6,523,996 | B2 | 2/2003 | Proper | |
| 6,582,866 | B2 | 6/2003 | Kumar et al. | |
| 6,586,150 | B2 | 7/2003 | Proper | |
| 6,599,673 | B2 | 7/2003 | Kumar et al. | |
| 6,752,561 | B2 | 6/2004 | Kumar et al. | 403/137 |
| 6,756,173 | B2 | 6/2004 | Proper | |
| 6,805,481 | B2 | 10/2004 | Kumar et al. | |
| 6,854,876 | B2 | 2/2005 | Dickson, Jr. | |
| 6,878,499 | B2 | 4/2005 | Proper | |
| 6,899,455 | B2 | 5/2005 | Proper | |
| 7,097,349 | B2 * | 8/2006 | Casalmir et al. | 366/309 |
| 2003/0063521 | A1 * | 4/2003 | Kumar et al. | 366/314 |
| 2003/0198127 | A1 | 10/2003 | Kumar et al. | |
| 2004/0213082 | A1 | 10/2004 | Tobler | |

FOREIGN PATENT DOCUMENTS

| | | | |
|---|---|---|---|
| GB | 2183496 | A | 10/1987 |

* cited by examiner

*Primary Examiner*—John L Goodrow
(74) *Attorney, Agent, or Firm*—Oliff & Berridge, PLC

(57) ABSTRACT

The present invention relates to a method for high intensity blending of toner particles in order to cause additive materials to become firmly affixed to the surface of base toner particles. The method includes using a blending tool having a shank with riser members at each end, such risers being angled outward from the axis of the shank between 10 and 16 degrees and having regions toward the trailing edges that are thicker than regions near the leading edges.

25 Claims, 8 Drawing Sheets

METHOD OF BLENDING TONERS USING A HIGH INTENSITY BLENDING TOOL WITH SHAPED RISERS FOR DECREASED TONER AGGLOMERATION

CROSS-REFERENCE TO RELATED APPLICATIONS

Reference is made to commonly-assigned co-pending U.S. Pat. No. 7,097,349, issued Aug. 29, 2006, by D. Paul Casalmir et al., the disclosures of which are incorporated herein.

BACKGROUND OF THE INVENTION

The field of the present invention relates to high intensity blending apparatus, particularly for blending operations designed to cause additive materials to become affixed to the surface of base particles. More particularly, the proposed invention relates to an improved blending tool for producing surface modifications to electrophotographic and related toner particles.

State of the art electrophotographic imaging systems increasingly call for toner particles having narrow distributions of sizes in ranges less than 10 microns. Along with such narrow distributions and small sizes, such toners require increased surface additive coverage since increased quantities of surface additives improve charge control properties, decrease adhesion between toner particles, and decrease Hybrid Scavangeless Development ("HSD") developer wire contamination in electrophotographic systems. The blending tool embodiments of the present invention enable a toner having a high degree of coverage by surface additives and having a high degree of adhesion of the surface additives to the toner particles. The present invention also relates to an improved method for producing surface modifications to electrophotographic and related toner particles. This method comprises using an improved blending tool to cause increased blending intensity during high speed blending processes.

A typical process for manufacture of electrophotographic, electrostatic or similar toners is demonstrated by the following description of a typical toner manufacturing process. For conventional toners, the process generally begins by melt-mixing the heated polymer resin with a colorant in an extruder, such as a Werner Pfleiderer ZSK-53 or WP-28 extruder, whereby the pigment is dispersed in the polymer. For example, the Werner Pfleiderer WP-28 extruder when equipped with a 15 horsepower motor is well-suited for melt-blending the resin, colorant, and additives. This extruder has a 28 mm barrel diameter and is considered semiworks-scale, running at peak throughputs of about 3 to 12 lbs./hour.

Toner colorants are particulate pigments or, alternatively, are dyes. Numerous colorants can be used in this process. A suitable toner resin is then mixed with the colorant by the downstream injection of the colorant dispersion. Examples of suitable toner resins which can be used include but are not limited to polyamides, epoxies, diolefins, polyesters, polyurethanes, vinyl resins and polymeric esterification products of a dicarboxylic acid and a diol comprising a diphenol.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like.

Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like. Resin binders for use in the present invention comprise polyester resins containing both linear portions and cross-linked portions of the type described in U.S. Pat. No. 5,227,460 (incorporated herein by reference above).

The resin or resins are generally present in the resin-toner mixture in an amount of from about 50 percent to about 100 percent by weight of the toner composition, and preferably from about 80 percent to about 100 percent by weight.

Additional "internal" components of the toner may be added to the resin prior to mixing the toner with the additive. Alternatively, these components may be added during extrusion. Various known suitable effective charge control additives can be incorporated into toner compositions, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. The internal charge enhancing additives are usually present in the final toner composition in an amount of from about 0 percent by weight to about 20 percent by weight.

After the resin, colorants, and internal additives have been extruded, the resin mixture is reduced in size by any suitable method including those known in the art. Such reduction is aided by the brittleness of most toners that causes the resin to fracture when impacted. This allows rapid particle size reduction in pulverizers or attritors such as media mills, jet mills, hammer mills, or similar devices. An example of a suitable jet mill is an Alpine 800 AFG Fluidized Bed Opposed Jet Mill. Such a jet mill is capable of reducing typical toner particles to a size of about 4 microns to about 30 microns. For color toners, toner particle sizes may average within an even smaller range of 4-10 microns.

Inside the jet mill, a classification process sorts the particles according to size. Particles classified as too large are rejected by a classifier wheel and conveyed by air to the grinding zone inside the jet mill for further reduction. Particles within the accepted range are passed onto the next toner manufacturing process.

After reduction of particle size by grinding or pulverizing, a classification process sorts the particles according to size. Particles classified as too fine are removed from the product eligible particles. The fine particles have a significant impact on print quality and the concentration of these particles varies between products. The product eligible particles are collected separately and passed to the next toner manufacturing process.

After classification, the next typical process is a high speed blending process wherein surface additive particles are mixed with the classified toner particles within a high speed blender. These additives include but are not limited to stabilizers, waxes, flow agents, other toners and charge control additives. Specific additives suitable for use in toners include fumed silica, silicon derivatives, ferric oxide, hydroxy terminated polyethylenes, polyolefin waxes, including polyethylenes and polypropylenes, polymethylmethacrylate, zinc stearate, chromium oxide, aluminum oxide, titanium oxide, stearic acid, and polyvinylidene fluorides.

The amount of external additives is measured in terms of percentage by weight of the toner composition, and the additives themselves are not included when calculating the percentage composition of the toner. For example, a toner composition containing a resin, a colorant, and an external additive may comprise 80 percent by weight resin and 20 percent by weight colorant. The amount of external additive present is reported in terms of its percent by weight of the combined resin and colorant. The combination of smaller toner particle sizes required by some newer color toners and the increased size and coverage of additive particles for such color toners increases the need for high intensity blending.

The above additives are typically added to the pulverized toner particles in a high speed blender such as a Henschel Blender FM-10, 75 or 600 blender. The high intensity blending serves to break additive agglomerates into the appropriate nanometer size, evenly distribute the smallest possible additive particles within the toner batch, and attach the smaller additive particles to toner particles. Each of these processes occurs concurrently within the blender. Additive particles become attached to the surface of the pulverized toner particles during collisions between particles and between particles and the blending tool as it rotates. It is believed that such attachment between toner particles and surface additives occurs due to both mechanical impaction and electrostatic attractions. The amount of such attachments is proportional to the intensity level of blending which, in turn, is a function of both the speed and shape of the blending tool. The amount of time used for the blending process plus the intensity determines how much energy is applied during the blending process. For an efficient blending tool that avoids snow plowing and excessive vortices and low density regions, "intensity" can be effectively measured by reference to the power consumed by the blending motor per unit mass of blended toner (typically expressed as Watts/lb). Using a standard Henschel Blender tool to manufacture conventional toners, the blending times typically range from one (1) minute to twenty (20) minutes per typical batch of 1 - 500 kilograms. For certain more recent toners such as toners for Xerox Docucenter 265 and related multifunctional printers, blending speed and times are increased in order to assure that multiple layers of surface additives become attached to the toner particles. Additionally, for those toners that require a greater proportion of additive particles in excess of 25 nanometers, more blending speed and time is required to force the larger additives into the base resin particles.

The process of manufacturing toners is completed by a screening process to remove toner agglomerates and other large debris. Such screening operation may typically be performed using a Sweco Turbo screen set to 37 to 105 micron openings.

The above description of a process to manufacture an electrophotographic toner may be varied depending upon the requirements of particular toners. In particular, for full process color printing, colorants typically comprise yellow, cyan, magenta, and black colorants added to separate dispersions for each color toner. Colored toner typically comprises much smaller particle size than black toner, in the order of 4-10 microns. The smaller particle size makes the manufacturing of the toner more difficult with regard to material handling, classification and blending.

The above described process for making electrophotographic toners is well known in the art. More information concerning methods and apparatus for manufacture of toner are available in the following U.S patents, each of the disclosures of which are incorporated herein: U.S. Pat. No. 4,338,380 issued to Erickson, et al; U.S. Pat. No. 4,298,672 issued to Chin; U.S. Pat. No. 3,944,493 issued to Jadwin; U.S. Pat. No. 4,007,293 issued to Mincer, et al; U.S. Pat. No. 4,054,465 issued to Ziobrowski; U.S. Pat. No. 4,079,014 issued to Burness, et al; U.S. Pat. No. 4,394,430 issued to Jadwin, et al; U.S. Pat. No. 4,433,040 issued to Niimura, et al; U.S. Pat. No. 4,845,003 issued to Kiriu, et al; U.S. Pat. No. 4,894,308 issued to Mahabadi et al.; U.S. Pat. No. 4,937,157 issued to Haack, et al; U.S. Pat. No. 4,937,439 issued to Chang et al.; U.S. Pat. No. 5,370,962 issued to Anderson, et al; U.S. Pat. No. 5,624,079 issued to Higuchi et al.; U.S. Pat. No. 5,716,751 issued to Bertrand et al.; U.S. Pat. No. 5,763,132 issued to Ott et al.; U.S. Pat. No. 5,874,034 issued to Proper et al.; and U.S. Pat. No. 5,998,079 issued to Tompson et al.

In addition to the above conventional process for manufacturing toners, other methods for making toners may also be used. In particular, emulsion/aggregation/coalescence processes (the "EA process") for the preparation of toners are illustrated in a number of Xerox Corporation patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488, and 5,977,210. The appropriate components and processes of the above Xerox Corporation patents can be selected for the processes of the present invention in embodiments thereof. In both the above described conventional process and in processes such as the EA process, surface additive particles are added using high intensity blending processes.

High speed blending of dry, dispersed, or slurried particles is a common operation in the preparation of many industrial products. Examples of products commonly made using such high-speed blending operations include, without limitation, paint and colorant dispersions, pigments, varnishes, inks, pharmaceuticals, cosmetics, adhesives, food, food colorants, flavorings, beverages, rubber, and many plastic products. In some industrial operations, the impacts created during such high-speed blending are used both to uniformly mix the blend media and, additionally, to cause attachment of additive chemicals to the surface of particles (including resin molecules or conglomerates of resins and particles) in order to impart additional chemical, mechanical, and/or electrostatic properties. Such attachment between particles is typically caused by both mechanical impaction and electrostatic bonding between additives and particles as a result of the extreme pressures created by particle/additive impacts within the blender device. Among the products wherein attachments between particles and/or resins and additive particles are important during at least one stage of manufacture are paint dispersions, inks, pigments, rubber, and certain plastics.

High intensity blending typically occurs in a blending machine, and the blending intensity is greatly influenced by the shape and speed of the blending tool used in the blending process. A typical blending machine and blending tool of the prior art is exemplified in FIGS. 1 and 2. FIG. 1 is a schematic elevational view of a blending machine 2. Blending machine 2 comprises a vessel 10 into which materials to be mixed and blended are added before or during the blending process. Housing base 12 supports the weight of vessel 10 and its contents. Motor 13 is located within housing base 12 such that its drive shaft 14 extends vertically through an aperture in housing 12. Shaft 14 also extends into vessel 10 through sealed aperture 15 located at the bottom of vessel 10. Upon rotation, shaft 14 has an axis of rotation that generally is orthogonal to the bottom of vessel 10. Shaft 14 is fitted with a locking fixture 17 at its end, and blending tool 16 is rigidly attached to shaft 14 by locking fixture 17. Before blending is commenced, lid 18 is lowered and fastened onto vessel 10 to prevent spillage. For high intensity blending, the speed of the rotating tool at its outside edge generally exceeds 50 ft./second. The higher the speed, the more intense, and tool speeds in excess of 90 ft./second, or 120 ft./second are common.

Various shapes and thicknesses of blending tools are possible. Various configurations are shown in the brochures and catalogues offered by manufacturer's of high-speed blending equipment such as Henschel, Littleford Day Inc., and other vendors. The tool shown in FIG. 1 is based upon a tool for high intensity blending produced by Littleford Day, Inc. and is discussed in more detail in relation to FIG. 3 discussed below. Among the reasons for different configurations of blending tools are (i) different viscosities often require differently shaped tools to efficiently utilize the power and torque of the blending motor; and (ii) different blending applications require different intensities of blending. For instance, some food processing applications may require a very fine distribution of small solid particles such as colorants and flavorings within a liquid medium. As another example, the processing of snow cones requires rapid and very high intensity blending designed to shatter ice cubes into small particles which are then mixed within the blender with flavored syrups to form a slurry.

As discussed more fully below, the shape of blending tool 16 greatly affects the intensity of blending. One type of tool design attempts to achieve high intensity blending by enlarging collision surfaces, thereby increasing the number of collisions per unit of time, or intensity. One problem with this type of tool is that particles tend to become stuck to the front part of the tool, thereby decreasing efficiency and rendering some particles un-mixed. An example of an improved tool using an enlarged collision surface that attempts to overcome this "snow-plowing" effect is disclosed in U.S. Pat. No. 6,523,996, entitled "BLENDING TOOL WITH AN ENLARGED COLLISION SURFACE FOR INCREASED BLEND INTENSITY AND METHOD OF BLENDING TONERS," hereby incorporated by reference. Even when overcoming the "snow-plow" effect, a second limitation of prior art tools with enlarged collision surfaces is that particles in the blender tend to swirl in the direction and nearly at the speed of the moving tool. Thus, the impact speed between the tool and a statistical average of particles moving within vessel 10 is less than the speed of the tool itself since the particles generally are moving in the same direction as the tool.

Another type of a blending tool that is more typically used for blending toners and additives is shown in FIG. 2 as tool 26. As shown, tool 26 comprises 3 wing shaped blades, each arranged orthoganally to the blade immediately above and/or below it. Tool 26 as shown has blades 27, 28, and 29. Blade 27, the bottom blade, is generally called "the scraper" and serves to lift particles from the bottom and provide initial motion to the particles. Blade 28, the middle blade, is called "the fluidizing tool" and serves to provide additional mechanical energy to the mixture. Blade 29, the top blade, is called the "horn tool" and is usually bent upward at an angle. The high speed distal tips proximal the wall of the blending vessel are primarily responsible for additive dispersion and inducing/providing impact/shear energy to attach the additive particles to the toner. Since tool 26 is designed such that each of its separate blades are relatively thin and therefore flow through the toner and additive mixture without accretion of particles on the leading edges, measure of the power consumed by the blending motor is a good indicator of the intensity of blending that occurs during use of the tool. This power consumption is measured as the specific power of a tool, defined as follows:

$$\text{SpecificPower} = \frac{\text{Load Power} - \text{No Load Power}}{\text{Batch Weight}} \text{[Watt/lb.]}$$

The Specific Power of tool 26 is shown in FIG. 8 in relation to different speeds of rotation. The significance of the data shown in FIGS. 9 and 10 is discussed below when describing advantages of an embodiment of the present invention. It should be noted, however, that tool 26 also embodies the limitation described above wherein the actual collision energy between particles is usually less than the speed of the tool itself since each of blades 27, 28, an 29 have the effect of swirling particles within the blending vessel in the direction of tool rotation.

Some tools of the prior art are designed to achieve blend intensity through creation of vortices and shear forces. One such tool is sold by Littleford Day Inc. for use in its blenders and appears in cross-section as tool 16 in FIG. 1. As shown in perspective view in FIG. 3, the Littleford tool 16 has center shank 20 with a central bushing fixture 17A for engagement with locking fixture 17 at the end of shaft 14

(both fixture 17 and shaft 14 are shown in FIG. 1). Bushing fixture 17A includes a notch conforming to a male locking key feature on locking fixture 17 (from FIG. 1). Arrow 21 shows the direction in which tool 16 rotates upon shaft 14. A second scraper blade 16A may be mounted below tool 16 onto shaft 14 as shown in FIG. 3. In the configuration shown, the Littleford scraper blade 16A comprises a shank mounted orthogonally to center shank 20 that emerges from underneath shank 20 in an essentially horizontal manner and then dips downward near its end region. The end region of blade 16A is shaped into a flat club shape with a leading edge near the bottom of the blending vessel (not shown) and the trailing edge sloping slightly upward to impart lift to particles scraped from the bottom of the vessel. The leading edge of the club shape runs from an outside corner nearest the blending vessel wall inwardly towards the general direction of shaft 14. The scraper blades are shorter than shank 20, and the combination of this shorter length plus the shape of the leading edge indicates that the function of the Littleford scraper blade is to lift particles in the middle of the blending vessel upward from the bottom of the vessel.

In contrast to the tool shown in FIG. 2, tool 16 comprises vertical risers 19A and 19B that are fixed to the end of center shank 20 at its point of greatest velocity during rotation around central bushing 17A. These vertical risers 19A and 19B are angled, or canted, in relation to the axis of center shank 20 at an angle of 17 degrees. In this manner, the leading edges 21A and 21A of risers 19A and 19B are proximate the wall of blending vessel 10 (from FIG. 1) while the trailing edges 22A and 22B are further removed from vessel wall 10. Applicant believes that tool 16 operates by creating shear forces between particles caught in the space created between the outside surface of risers 19A and 19B and the wall of vessel 10. Since trailing edges 22B and 22A are further removed from the wall, a vortex is created in this space. It is believed that particles trapped in these vortices follow the tool at or nearly at the speed of leading edges 19A and 19B. In contrast, particles that have slipped through gap between leading edge 19A and 19B and the wall of vessel 10 remain nearly stationary. When particles swept along within the vortices behind leading edges 19A and 19B impact the nearly stationary particles along the vessel wall, then the speed of collision is at or nearly at the speed of the leading edges of the tool. Applicant has not found literature that describes the above effects. Instead, the above analysis results from Applicants' own investigation of blending tools.

An improvement upon the Littleford tool shown in FIGS. 1 and 3 is disclosed in U.S. Pat. No. 6,752,561, issued Jun. 22, 2004 to Kumar et al, which is hereby incorporated herein in its entirety. The tool of the '561 patent is shown in FIG. 4 and comprises a shank having a riser member at each end, such risers being angled to the axis of the shank between 10 and 16 degrees and having a height dimension greater that 20 percent of the diagonal dimension of the shank.

Although the tool shown in FIG. 4 has proven to achieve the specific power and blend intensity described in the '561, several problems have arisen. Specifically, experience has shown that the tool in FIG. 4 is prone to a static toner accumulation proximate to the rear of the inside edge of each riser. Toner that aggregates in such accumulation does not get blended adequately. A certain amount of such inadequately blended toner typically becomes loose during or after the blending operation, thereby resulting in a portion of a toner batch having inadequate additive coverage or adhesion. Without sufficient additive adhesion and coverage, the affected toner particles are likely to perform poorly during imaging operations. Accordingly, it would be very desirable to design a blending tool that creates substantially the same specific power and blending intensity as the tool described in the '561 patent but which incurs little or no static toner accumulation.

A second problem with the tool disclosed in the '561 patent is that the intense centrifugal forces imposed on the tool tends to bend the shank downward and, separately, the risers outward. Together, these deflections can cause structural failure of the tool. The bending is sufficient to permanently deform the risers outward from the intended vertical angle to the shank. Even without structural failure of the tool, such deflections can cause the tool to touch the blend chamber wall at high rotation speeds. The root cause of the deflections is the extreme bending moments of the tool at high rotation speeds that cause local stress levels to exceed the yield stress of the material. Although the tool can be reinforced with more material to inhibit deflection, such reinforcement increases tool mass, thereby decreasing blending efficiency while modestly increasing the amount of toner accumulation on the riser inside edge.

A third problem resulting from use of the tool of the '561 patent is that temperatures within the blending vessel may become undesirably high. When blending toners with the '561 tool, temperatures of 130 F are common. Such temperatures are uncomfortably close to the transition temperature of toner resins and, accordingly, risk melting and fusing of toner particles within the blending vessel.

As described above, the process of blending plays an increasingly important role in the manufacture of electrophotographic and similar toners. It would be advantageous if a blending tool design and blending method were found that achieves at least the same specific power and blending intensity as the tool of the '561 patent while minimizing static powder accumulation and outward deflection of the tool risers while maintaining temperatures within the blending vessel well below transition temperatures of typical toner resins.

SUMMARY OF THE INVENTION

One aspect of the present invention is a method of blending toners, comprising: adding toner particles comprising a mixture of toner resin and colorants to the blending vessel of a blending machine; adding surface additive particles to the mixture of toner particles; and blending the toner particles and surface additive particles in the blending machine using a rotating blending tool comprising a center shank having a long axis, at least one end, and an end region proximate to the end plus a riser member fixedly mounted during rotation at the end region of the shank, said riser member having a forward region and a region near its trailing edge, wherein the riser member is thicker in the region near its trailing edge than in the forward region and wherein said riser member has an outside surface with a forward region angled outward from the long axis of the shank.

BRIEF DESCRIPTION OF THE DRAWINGS

Other aspects of the present invention will become apparent as the following description proceeds and upon reference to the drawings, in which.

DETAILED DESCRIPTION OF THE DRAWINGS

While the present invention will hereinafter be described in connection with its preferred embodiments and methods of use, it will be understood that it is not intended to limit the invention to these embodiments and method of use. On the contrary, the following description is intended to cover all alternatives, modifications, and equivalents, as may be included within the spirit and scope of the invention as defined by the appended claims.

One aspect of the present invention is creation of a blending tool capable of generating intense blending energy as a result of intense shear forces that result in high differentials in velocities among particles that impact each other in the shear zone. The large differential in velocity between colliding particles allows blending time to be relatively short, thereby saving batch costs and increasing productivity. Such intense blending produces toners with large quantities of additive particles adhering to toner particles and with high average forces of adhesion between additive particles and toner particles.

Figure 1:
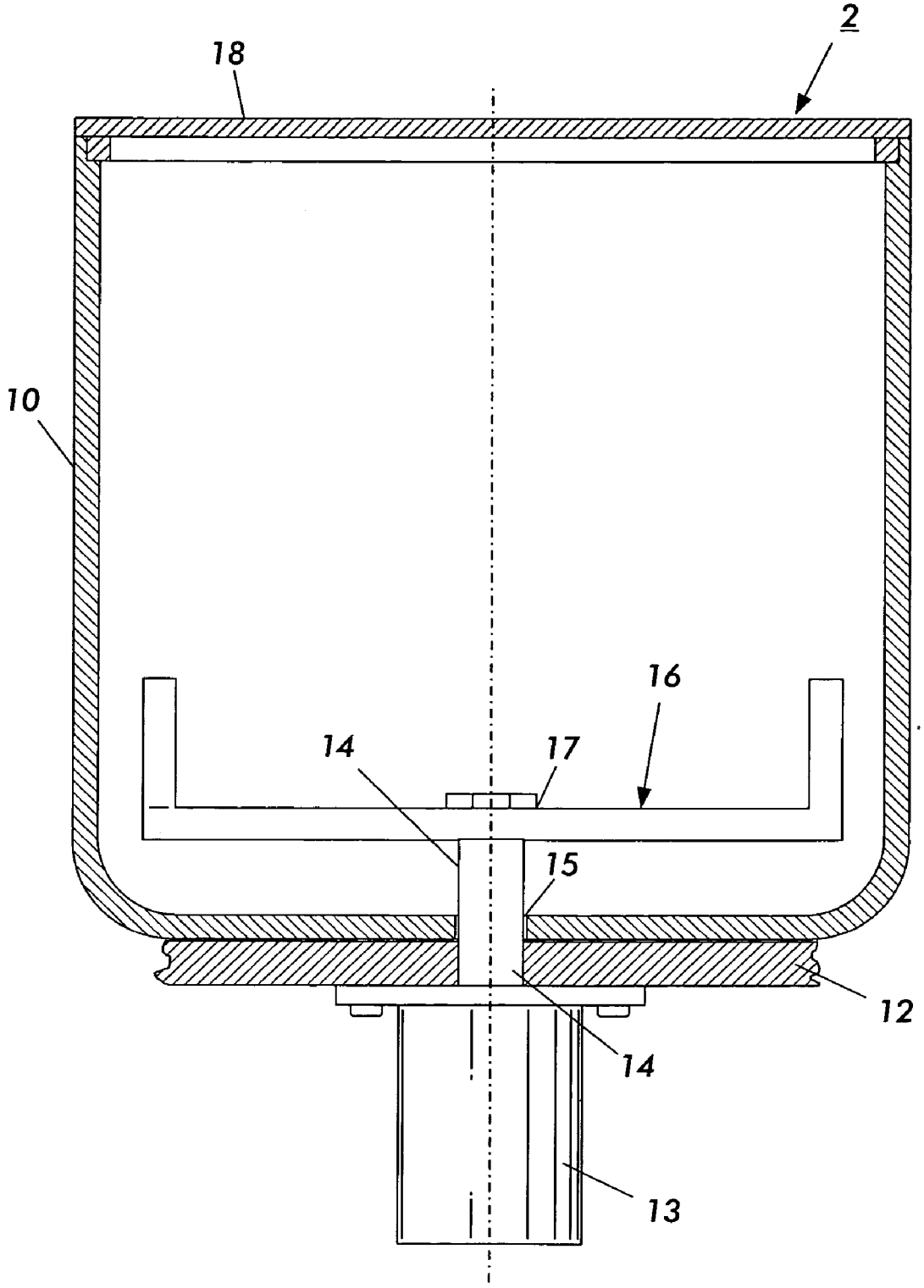
FIG. 1 PRIOR ART
FIG. 1 is a schematic elevational view of a blending machine of the prior art.
Figure 2:
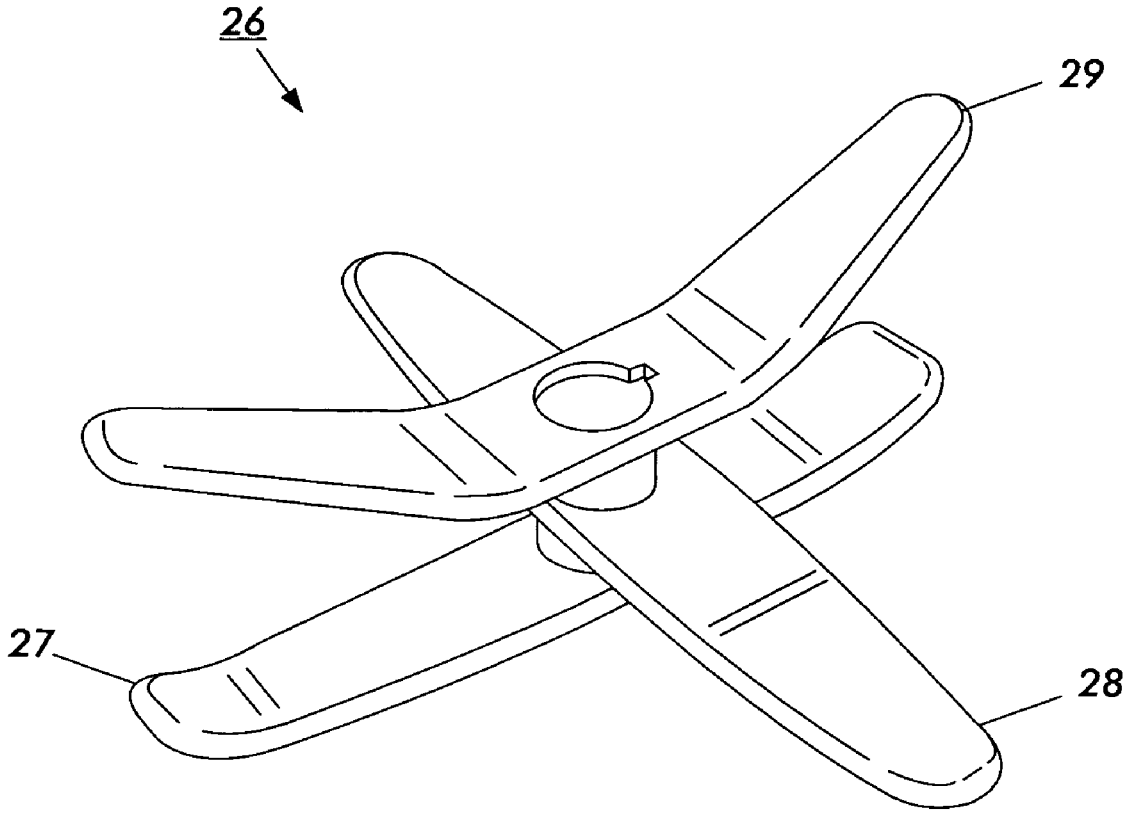
FIG. 2 PRIOR ART
FIG. 2 is a perspective view of a blending tool of the prior art.
Figure 5:
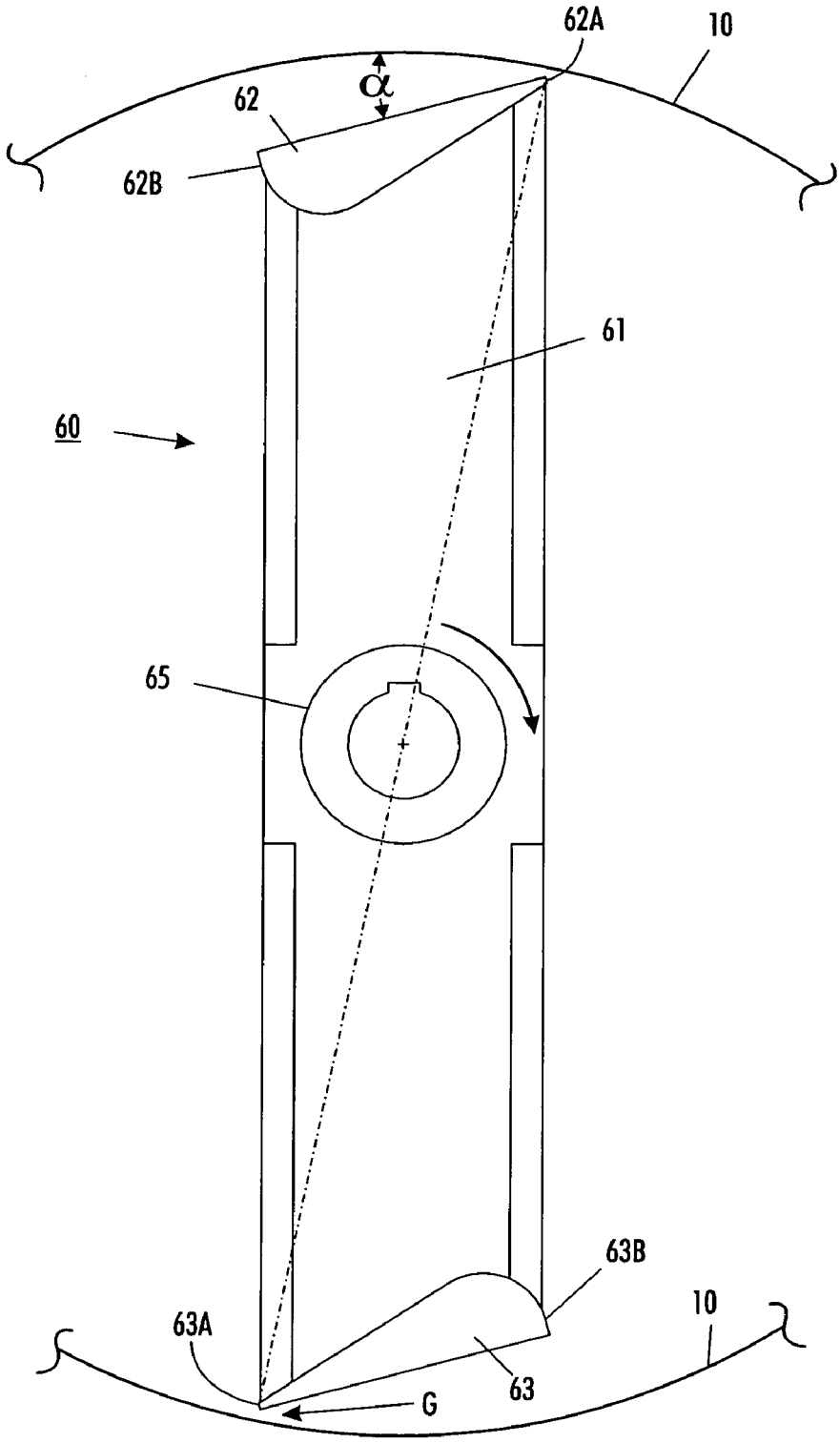
FIG. 5 is a perspective view of an embodiment of a blending tool of the present invention.

Accordingly, blending tool 60 as shown in FIG. 5 is one embodiment of the blending tool of the present invention. FIG. 5 shows tool 60 in a schematic overhead view. Center shank 61 of tool 60 contains locking fixture 65 at its middle for mounting onto a rotating drive shaft such as shaft 14 of the blending machine 2 in FIG. 1. Vertical risers 62 and 63 are attached at each end of shank 61.

Figure 3:
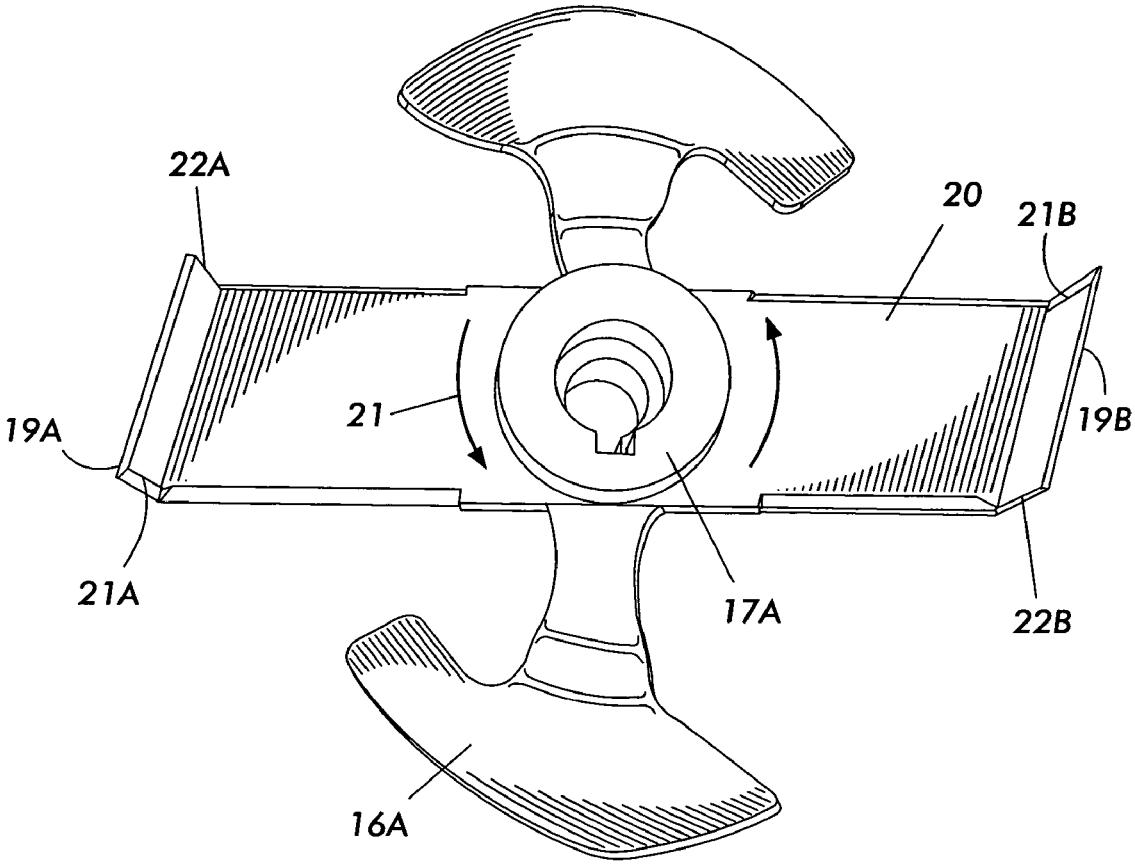
FIG. 3 PRIOR ART
FIG. 3 is a perspective view of a second blending tool of the prior art.
Figure 4:
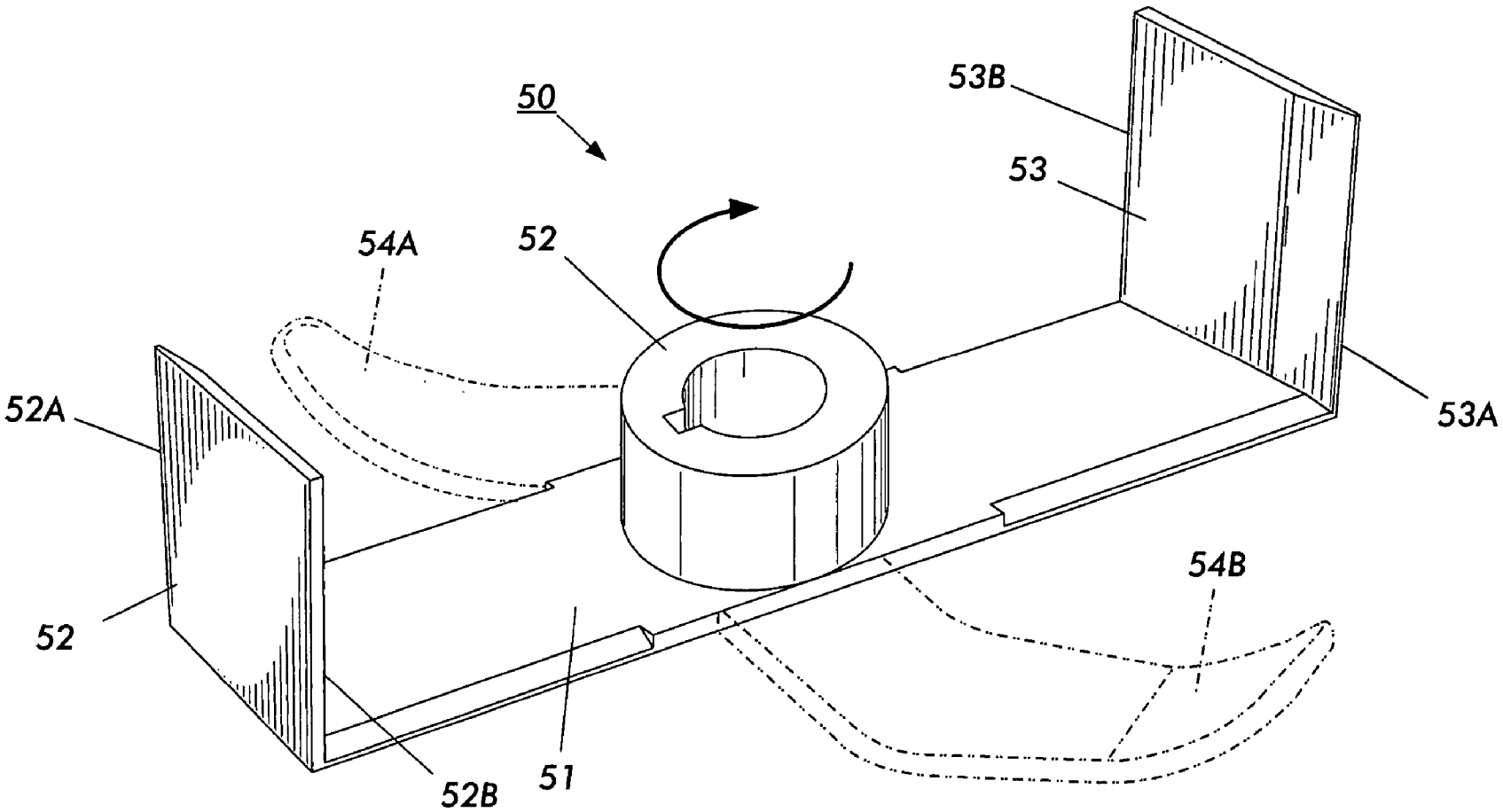
FIG. 4 PRIOR ART
FIG. 4 is a perspective view of a third blending tool of the prior art.

In a manner similar to the '561 tool shown in FIG. 4 and the Littleford tool shown in FIG. 3, vertical risers 62 and 63 are angled, or canted, in relation to the long axis of shank 61. Leading edges 62A and 63A are closer to the blending vessel wall than trailing edges 62B and 63B. The result is that the outside surface of riser 62 has a forward region proximate to leading edge 62A that is angled outward from the axis of center shank 61. FIG. 5 shows this effect, with the gap, G, between leading edge 63A and the wall of vessel 10 being approximately 5 millimeters when tool 60 is sized for a 10 liter blending vessel. Particles that pass within this gap, G, remain relatively stationary in relation to the wall of vessel 10. Once leading edge 63A has swept past a particular particle in gap G, however, then it becomes subject to vortices formed along the outside surface of riser 63. These vortices form because riser 63 angles away from the wall of vessel 10, thereby inducing a partial vacuum in the space between the outside surface of riser 63 and vessel wall 10. Some particles remain "trapped" within these vortices and are swept along at speeds approximating the velocity of riser 63 itself. The highest impact energies between particles occur when these swept along particles traveling at nearly the speed of riser 63 impact nearly stationary particles that had slipped through gap G. The number of these collisions is greatly increased by the angle of riser 63 in relation to shank 61 since the induced vortices tend to pull the nearly stationary particles towards riser 63.

In FIG. 5, the angle between the axis of the shank and the outside surface of the risers is labeled as angle $\alpha$. Angle $\alpha$ equals the angle between the axis of the outside surface of risers 62 and 63 and a line that passes through distal leading edge tips 62A (or r3A) and that is orthogonal to the axis of shank 61. In FIG. 5, the outside surface of risers 62 and 63 lie approximately in a flat plane. For embodiments of the invention in which the outside surfaces vary from a flat plane, the axis of the outside surface is a line conforming with the averaged slope of the outside surface or of the region of the outside surface being considered. As with the tool of the '561 patent, the angle of $\alpha$ for tools of the present invention are generally between about 10 and about 16 degrees and optimally about 15 degrees although $\alpha$ angles of about 8 to about 20 degrees achieve acceptable performance at sufficient rotation speeds. The height dimension of risers 62 and 63 in the embodiment shown in FIG. 5 are similarly approximately the same as the height dimension of the '561 tool. For a tool designed for a 10-liter blending vessel 10, the riser height is 63 millimeters. Regardless of the size of the blending vessel, the ratio of the riser height to the diagonal shank length, $D_{Tool}$, is about 0.286. For a 872 millimeter $D_{Tool}$, dimension suitable for a 600 liter production blending vessel, the height of risers 62 and 63 in this embodiment is approximately 249 millimeters, plus or minus about 20 millimeters.

A difference between tools of the present invention and tools of the '561 patent is the reverse air foil-like shape of risers 62 and 63. The thicker riser shape in regions toward each of the trailing edges 62B and 63B are intended both to strengthen risers 62 and 63 as well as prevent static powder accumulation. The shape and volume of such bulge in each riser is determined by the pattern of static powder accumulation detected on straight risers similar to those of the '561 tool shown in FIG. 4. Specifically, the size and shape of the bulge as shown in FIG. 5 emulates the size and shape of static powder accumulation that would have accumulated if straight-sided risers were used. Preferably, the size and shape of the bulge somewhat exceeds the size and shape of such static powder accumulation. By entirely filling the volume that would otherwise become filled with static powder accumulation, then any powder that contacts the bulge is swept away by the vortices and flows that prevented static powder accumulation from growing beyond that size and shape when using a straight-sided riser. Of course, bulges on the interior side of risers need not conform to the size and shape of such predicted or experienced straight-sided static accumulation. Bulges that fail to fill a portion of the static accumulation volume risk having some accumulation fill the remaining volume. Bulges that fail to conform to the shape of static accumulation on straight-sided risers risk distortion of the vortices and flows around the riser, thereby increasing the risk that some accumulations will occur or that efficiency of the tool may be decreased.

In the tool shown in FIG. 5, leading edges 62A and 63A of the risers are relatively pointed and present a front face of only about 4 millimeters in width. The optimal slope of increasing thickness toward the trailing edges of the risers varies with such factors as the expected velocity of the tool, the density and adhesion of the powder to be blended, and the shape of the blending vessel. For the toner powders intended for blending with the tool shown in FIG. 5, an outward slope from a straight side from about 12 to about 24 degrees appears workable with a preferred range from about 16 to about 20 degrees, or about 18 degrees. In the tool shown in FIG. 5, the trailing edge of the tool is created by a radial arc edge intersecting near the trailing edge of the riser and intersecting the sloped inside edge between about 66 and 75 percent of the length back from the leading edge of the tool or, preferably, about 72 percent back from the leading edge of the tool. As described above, the actual distance and shape of the rear edge of the bulge may differ depending upon the powder and process conditions. In general, however, a rounded rear edge appears preferred since such an edge minimizes likely trailing vortices or voids that could cause static accumulations on the rear edge itself.

Figure 6:
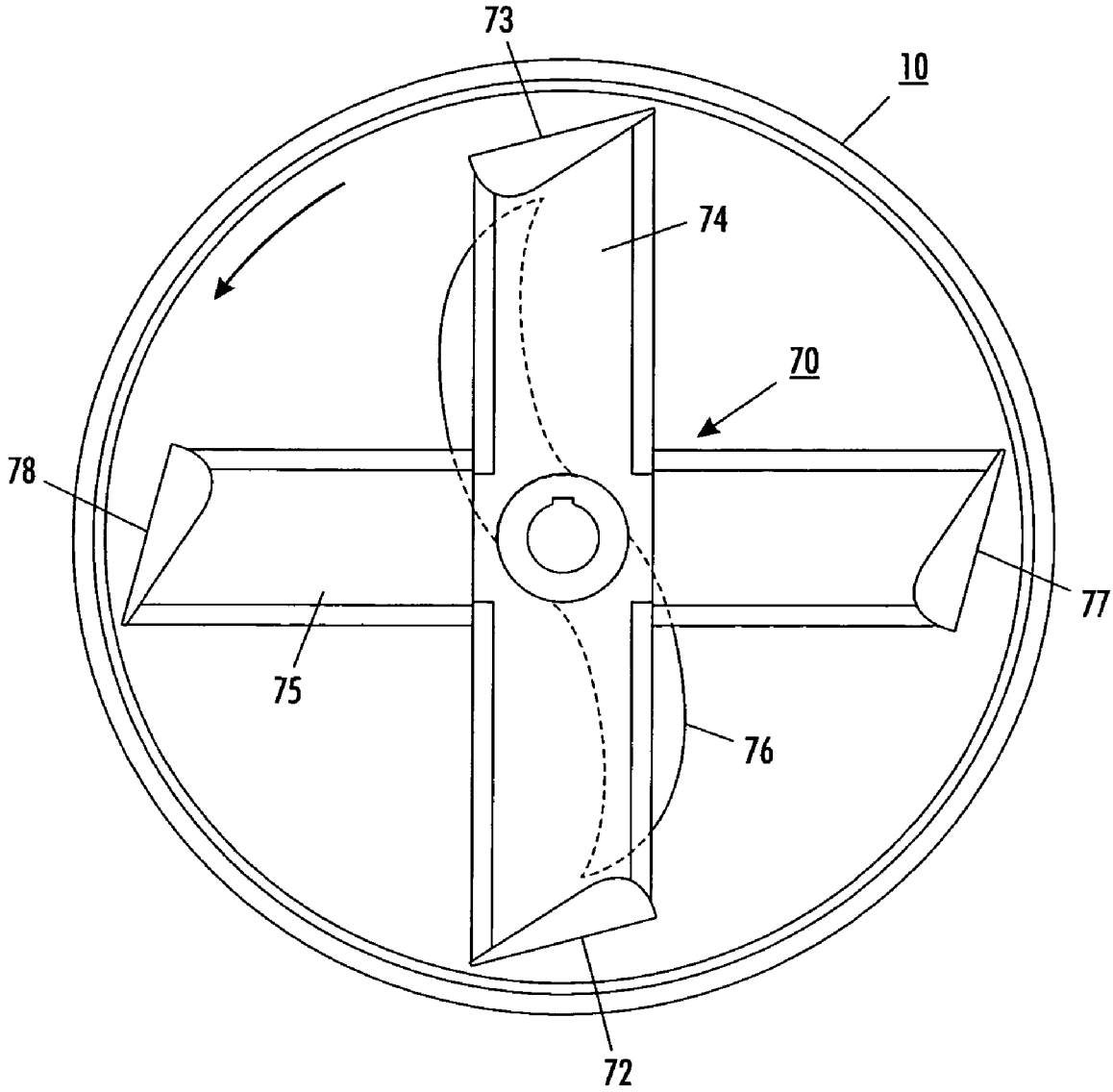
FIG. 6 is a vertical overhead view of the footprint of an embodiment the present invention when placed into a blending vessel.

FIG. 6 shows another embodiment of a tool of the present invention in an overhead vertical schematic view. In this embodiment, tool 70 comprises two shanks, 74 and 75, instead of one. At the end region of each shank are risers similarly shaped with the reverse air foil shape of tool 60 shown in FIG. 5. Underneath the two shanks is an S-shaped scraper tool 76 similar to the scraper tool shown in prior art FIG. 4. Since shanks 74 and 75 are orthogonal to each other, scraper tool 76 is mounted with an initial shank angle that approximately bisects the arc between shanks 74 and 75, i.e., is offset approximately 45 degrees from either shank 74 and 75. If such a scraper tool 76 were used with a single shank tool such as shown in FIG. 5, it preferably would be mounted approximately orthogonally to the single shank. Scraper tool 76 has "swept-back" leading edges such that the axis of these blades is angled backwards, away from the direction of rotation. This swept-back feature allows particles to remain in contact with or in proximity to the blades for a longer period of time by rolling outward along the swept-back edges. Also, even without such rolling, the swept-back angle imparts a directional vector to collided particles that sends them outward toward the walls of vessel 10. By increasing the density of particles along the walls of vessel 10, this swept-back feature greatly increases the intensity imparted by risers 72 and 73 and risers attached to shank 75 since these risers operate in proximity to the vessel walls.

Figure 7:
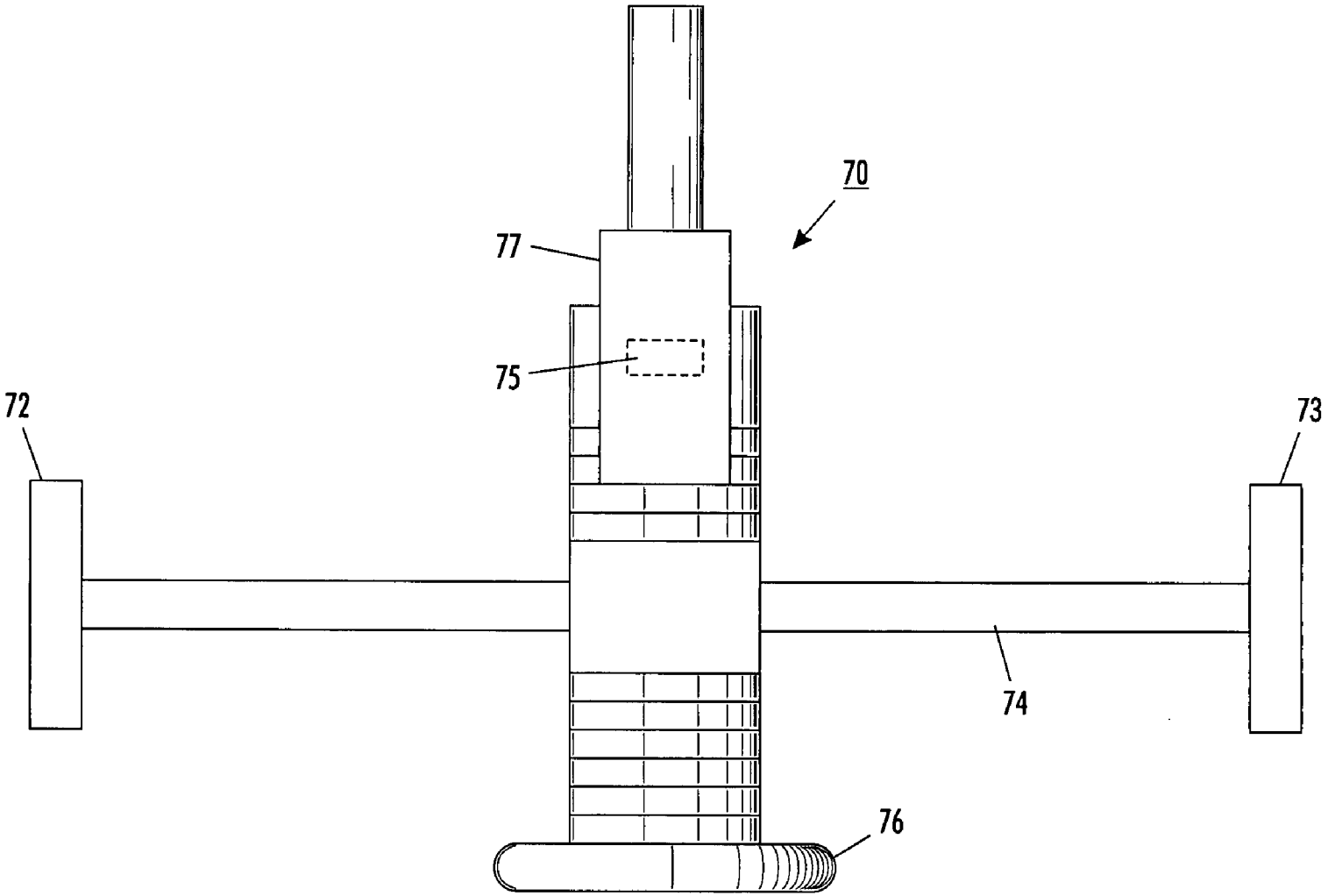
FIG. 7 is a schematic plan view of an embodiment of the present invention.

FIG. 7 shows a schematic plan view of tool 70. In this view, shank 74 is situated below shank 75. Scraper tool 76 is located below both shanks 74 and 75. As shown in FIG. 6, both shanks 74 and 75 have risers located in their end regions. In contrast to tool 60 shown in FIG. 5, risers 72 and 73 are attached to shank 74 at about the middle of each riser rather than at the bottom end. Risers attached to shank 75 are similarly mounted at about their middle height. The effect of such mounting in the middle of the risers is to balance the centrifugal forces on the risers such that the forces above shank 74 approximately balance the forces below shank 74, thereby ameliorating or avoiding the forces that cause the risers of tool 50 of the prior art to be bent outward during use. Coupled with the reinforcement offered by the bulge described above, this balancing of forces above and below shank 74 should eliminate the deformation observed using prior art tool 50 shown in FIG. 4.

Another difference between the risers of tool 70 and the risers of tool 60 are that the risers of tool 70 are individually shorter than the risers of tool 60. More particularly, each of the risers of tool 70 are about 120 millimeters high for use in a 600 liter blending vessel. For a tool having a $D_{Tool}$ diameter of about 872, the ratio of riser height to $D_{Tool}$ is about 0.138. The same height/$D_{Tool}$ ratio would approximately apply to embodiments of the present invention designed for different sized blending vessels. The effect of having smaller risers is that each riser by itself does less work and is subjected to less centrifugal stress because of the diminished height.

Another feature of tool 70 shown in FIG. 7 is the height relationship between shanks 74 and 75 and the risers attached to each. As shown, the tops of risers 72 and 73 sweep through a zone that overlaps the zone swept by adjacent riser 77 by approximately 10 millimeters although an overlap of 0 through 25 millimeters is also acceptable. The effect of the height offset and the slight overlap in zones swept by the risers of tool is that the aggregate height of the risers on both shanks is approximately the same as the height of the single shank tools shown in FIGS. 4 and 5. Specifically, with a height overlap of approximately 10 millimeters, the aggregate height of the risers shown in FIG. 7 is approximately 230 millimeters for a toll designed for a 600-liter blending vessel. The similar height for tool 60 shown in FIG. 6 is approximately 240. By offsetting the heights of the risers, it is believed that riser-to-riser interactions are minimized. Specifically, it is believed that if all 4 risers were at the same height and swept through the same zone, then the density of particles encountered within the zone is likely to be less. This occurs since each riser pushes particles aside, and if the next riser sweeps through the same zone, then particles may not have redistributed into the voids created by the preceding riser. The problem described would be exacerbated with a 4-riser tool when compared to the conventional 2-riser tool shown in FIG. 4 since there is less space and time between risers for redistribution to fill the voids left in a riser's wake. By offsetting the height of the risers as shown in FIGS. 6 and 7, each riser sweeps through a zone vertically offset from the riser preceding it.

A further advantage of offsetting the risers as shown in FIGS. 6 and 7 is that flow of particles within the blending vessel is improved when compared to the prior art tools of FIGS. 4 and 5. Such improved flow is deduced by observing that fewer particles coat the vessel walls when using vertically offset 4-riser tools when compared to the conventional 2-large riser tool shown in FIGS. 4 and 5. Less coating of the vessel wall achieves the further advantage of lowering process temperatures within the vessel by about 10 F. This lowered temperature is believed to result since the slight particle coating induced under the prior art acted as an insulator to inhibit conduction of heat through the blend vessel metal walls.

Yet another advantage of embodiments of the present invention is improved heat transfer within the batch being processed, thereby lowering batch processing temperatures significantly below the glass transition temperature of materials such as toners. Observations of batches made with the prior art tool shown in FIGS. 4 and 5 showed that a thin layer of toner tended to adhere to the blending vessel wall, thereby providing limited thermal insulation that inhibited heat transfer through the vessel wall. It is believed that the tool of FIGS. 6 and 7 creates improved flow distribution within the blending vessel, thereby further inhibiting attachment of toner to the vessel walls. Without such an insulating layer of toner particles, the vessel walls conduct away more heat, and the batch processing temperature has been observed to be lowered by approximately 10 F degrees to a maximum of approximately 119 F degrees.

Figure 8:
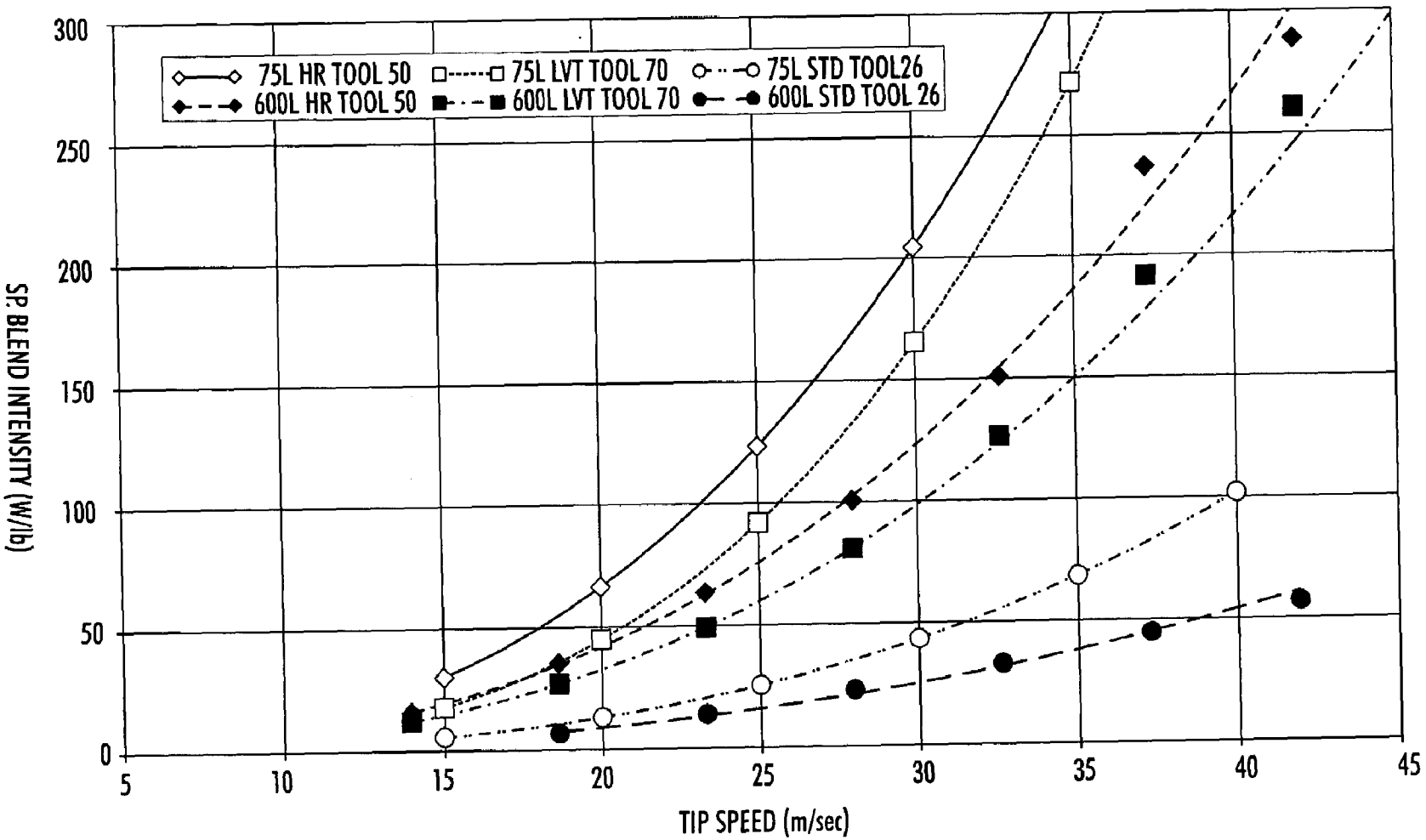
FIG. 8 is a graph showing specific power values varying with tool tip speed (and revolutions per minute) for several blending tools at the 75 liter and 600 liter blender scales.

One minor disadvantage of the tool shown in FIGS. 6 and 7 is that it generates somewhat less specific power than the prior art tools similar to those shown in FIG. 4. For blending toners in order to optimize additive coverage and adhesion to toner particles, specific power of approximately 230 Watts/lb or more is desired. FIG. 8 shows a comparison of specific power v. RPM curves for both the tool shown in FIGS. 6 and 7 and the prior art tool shown in FIG. 4. As can be seen, the tool of FIGS. 6 and 7 reaches the desired 230 Watts/lb specific power threshold at approximately 50-100 RPMs greater than the prior art tool. FIG. 8 shows that the tool of FIGS. 6 and 7 reach 230 Watts/lb. at approximately at 870 RPMs rather than at approximately 810 RPMs for the prior art tool. This minor inefficiency is not material when using the blending machines typically used for blending toners. Although increased blending times would be required at lower speeds, it is believed that RPM speeds as low as 750 when using the embodiment of FIGS. 6 and 7 could be used to blend toners. As shown in FIG. 8, the tool is robust enough to withstand rotational speeds at least up to 1000 RPMs at the 600 L scale and 2000 RPMs at the 75 L scale. For both tanks, this equates to tip speeds at least up to 46 meters per second. Accordingly, embodiments of the present invention similar to that shown in FIGS. 6 and 7 are very suitable for use in production of toners.

In summary, the improved blending tool of the present invention and blending machine using such tool include raised risers at the end of a central shank, such risers being angled to the axis of the shank and being thicker towards their trailing edge. Tools of the present invention, when compared to prior art tools used at high blending speeds to blend materials such as toners, ameliorate problems of static particle accumulation on the risers as well as defection of the risers and the bending of the shank due to high centrifugal moments. Additionally, the use of multiple shanks and corresponding risers results in a desirable lower batch process temperature. The improved tool may also have "swept-back" scraper blades mounted at the mid-section of the central shank. Embodiments of the present invention accordingly represent improvements upon the prior art.

It is, therefore, evident that there has been provided in accordance with the present invention a blending tool and toner particles that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method of blending toners, comprising adding toner particles comprising a mixture of toner resin and colorants to the blending vessel of a blending machine;

adding surface additive particles to the mixture of toner particles; and blending the toner particles and surface additive particles in the blending machine using a rotating blending tool comprising a center shank having a long axis, at least one end, and an end region proximate to the end plus a riser member fixedly mounted during rotation at the end region of the shank, said riser member having a forward region and a region near its trailing edge, wherein the riser member is thicker in the region near its trailing edge than in the forward region, wherein said riser member has an outside surface with a forward region angled outward from the long axis of the shank, and wherein the riser member has an inside surface that bulges inwardly toward the trailing edge in a shape that approximates the size and shape of powder accumulation that would occur if the riser member were a generally planar shape.

2. The method of claim 1, wherein blending further comprises rotating at least a portion of the riser member at a speed greater than 32 meters/second.

3. The method of claim 1, wherein blending further comprises rotating at least a portion of the riser member at a speed greater than 40 meters/second.

4. The method of claim 1, wherein blending further comprises rotating the blending tool at a velocity sufficient to generate in excess of approximately 230 Watts/pound or specific power.

5. The method of claim 1, wherein the forward region of the outside surface of the riser member has an axis and wherein the angle between the axis of the forward region and a plane that passes through the distal tip of the riser member that is orthogonal to the long axis of the shank is between about 10 and about 16 degrees.

6. The method of claim 1, wherein the forward region of the outside surface of the riser member has an axis and wherein the angle between the axis of the forward region and a plane that passes through the distal tip of the riser member that is orthogonal to the long axis of the shank is between about 14 and about 15.5 degrees.

7. The method of claim 1, wherein the outside surface has an axis and wherein the wherein the angle between the axis of the outside surface and a plane that passes through the distal tip of the riser member that is orthogonal to the long axis of the shank is between about 10 and about 16 degrees.

8. The method of claim 1, wherein the riser member has an inside surface and wherein at least a portion of the inside surface slopes toward the trailing edge at an angle from the axis of the outer surface between about 12 to about 24 degrees.

9. The method of claim 1, wherein the riser member has an inside surface and wherein at least a portion of the inside surface slopes toward the trailing edge at an angle from the axis of the outer surface between about 16 to about 20 degrees.

10. The method of claim 1, wherein the riser member has an inside surface and wherein at least a portion of the inside surface slopes toward the trailing edge at an angle from the axis of the outer surface about 18 degrees.

11. The method of claim 1, wherein the riser member has an arcuately shaped trailing edge.

12. The method of claim 1, wherein the riser member has a leading edge and wherein the riser member begins thinning toward its trailing edge beginning between about 66 and about 75 percent of the distance back from the leading edge of the riser.

13. The method of claim 1, wherein the riser has a height dimension and wherein the riser mounts to the shank at a location between about 40 to about 60 percent along the height dimension.

14. The method of claim 1, wherein the shank comprises a plurality of shanks, each having riser members.

15. The method of claim 1, further comprising a second shank arranged approximately orthogonally to a first shank, each having riser members.

16. The method of claim 14, wherein the plurality of shanks are arranged at different heights along the blending machine shaft.

17. The method of claim 16, wherein the shaft has a height dimension and wherein each riser has a height and wherein the heights of adjacent risers overlap along the height dimension of the shaft.

18. The method of claim 16, wherein the heights of adjacent risers overlap along the height dimension of the shaft by between about 0 to about 25 millimeters.

19. The method of claim 1, wherein:

(a) the blending machine shaft has an axis of rotation and imparts a direction of rotation to the improved blending tool;

(b) a direction exists that is orthogonal to the long axis of the shank and to the rotation axis of the shaft; and (c) the blending tool further comprises at least one blade extending outward from the shank wherein at least a portion of said blade is swept backward from the orthogonal direction away from the direction of rotation.

20. The method of claim 19, further comprising a scraper tool mounted to the shaft below the shank.

21. The method of claim 14, further comprising a scraper tool mounted to the shaft below the shank at an angle that approximately bisects the arc angle between two adjacent shanks.

22. The method of claim 21, wherein the leading edges of the scraper tool are swept backward from the direction of rotation.

23. The method of claim 1, wherein the blending tool is designed to withstand rotational speeds between about 700 to about 900 revolutions per minute.

24. The method of claim 1, wherein the blending tool is designed in order that at least a portion of the riser withstands rotational speeds of 46 meters per second.

25. The method of claim 1, wherein:

(a) the blending vessel has a wall;

(b) the riser member has a leading edge; and (c) at least a portion of the leading edge is positioned within 6 millimeters of the wall.

* * * * *